United States Patent [19]

Brierley et al.

[11] Patent Number: 4,530,775

[45] Date of Patent: Jul. 23, 1985

[54] STABLE LIQUID DETERGENT SUSPENSIONS

[75] Inventors: John M. Brierley; Melvin Scott, both of South Wirral, England

[73] Assignee: Lever Brothers Company, New York, N.Y.

[21] Appl. No.: 439,709

[22] Filed: Nov. 8, 1982

[30] Foreign Application Priority Data

Nov. 13, 1981 [GB] United Kingdom ..... 8134309

[51] Int. Cl.[3] ..... C11D 3/14; C11D 7/12; C11D 7/16; C11D 9/18

[52] U.S. Cl. ..... 252/128; 252/89.1; 252/140; 252/155; 252/174.14; 252/174.19; 252/174.21; 252/174.25; 252/529; 252/540; 252/548; 252/559; 252/DIG. 14

[58] Field of Search ..... 252/540, 559, 529, 548, 252/174.14, 174.21, 174.19, 89.1, 155, 174.25, DIG. 14, 140

[56] References Cited

U.S. PATENT DOCUMENTS

| | | | |
|---|---|---|---|
| 2,992,993 | 7/1961 | Pengilly | 252/529 |
| 3,210,286 | 10/1965 | Gangwisch . | |
| 3,935,129 | 1/1976 | Jabalee . | |
| 3,956,158 | 5/1976 | Donaldson | 252/102 |
| 4,155,882 | 5/1979 | Davies et al. . | |
| 4,174,304 | 11/1979 | Flanagan | 252/174.14 |
| 4,233,172 | 11/1980 | McLaughlin | 252/174.14 X |
| 4,302,347 | 11/1981 | Straw et al. | 252/140 |
| 4,397,755 | 8/1983 | Brierley et al. | 252/DIG. 14 |

FOREIGN PATENT DOCUMENTS

| | | |
|---|---|---|
| 0050887 | 5/1982 | European Pat. Off. . |
| 882569 | 11/1961 | United Kingdom . |
| 938783 | 10/1963 | United Kingdom . |
| 939366 | 10/1963 | United Kingdom . |
| 955081 | 4/1964 | United Kingdom . |
| 1370377 | 10/1974 | United Kingdom . |
| 1516977 | 7/1978 | United Kingdom . |
| 1534680 | 12/1978 | United Kingdom . |

*Primary Examiner*—John E. Kittle
*Assistant Examiner*—Mukund J. Shah
*Attorney, Agent, or Firm*—Milton L. Honig; James J. Farrell

[57] ABSTRACT

Liquid media, capable of stably suspensing undissolved particulate material, comprise, in an aqueous medium, an anionic detergent, a non condensed phosphate electrolyte and a fatty acid monoalkylolamide. Such media, and the suspensions of undissolved particulate material therein, have a significantly improved shear stability. The media are particularly useful to suspend particulate abrasive material to yield liquid abrasive cleaning compositions.

3 Claims, No Drawings

STABLE LIQUID DETERGENT SUSPENSIONS

The present invention relates to stable liquid detergent compositions comprising a liquid medium capable of stably suspending non-colloidal undissolved particulate material therein.

Liquid detergent compositions containing a liquid aqueous medium in which undissolved particulate material is suspended, are well-known in the art. Typical examples thereof are built liquid detergent compositions which contain either water-soluble inorganic and/or organic builders at a level above their solubility in the liquid medium, the undissolved part of these builders being suspended in that medium, or water-insoluble builder materials which are suspended as a whole in the liquid medium. Typical examples of the former builders are the polyphosphate builders, and examples of the latter are the zeolite builders.

Other typical liquid detergent compositions comprising an undissolved particulate material suspended in a liquid medium are those which contain an insoluble particulate abrasive material suspended therein. Such compositions are more commonly known as liquid abrasive cleaning compositions. Typical examples of abrasive particulate materials suspended in such liquid compositions are calcite, silica, felspar, pumice and the like.

Often during the manufacture of such liquid detergent compositions containing undissolved particulate material suspended in a liquid medium, these compositions or the liquid suspending media from which they can be prepared may undergo high extensional flows. High extensional shear rates may occur in valves, filters, pumps and pipe bends used in the course of the manufacture of such liquids. We have found that high extensional shear rates may cause a break-down of the liquid medium or suspension, as the case may be, whereby phase separation and, in the case of compositions containing undissolved particulate material, also deposition of the undissolved particulate material can occur. Such a break-down is associated with a reduced viscosity. We have found that this break-down occurs particularly at high shear rates, e.g. at rates of 20,000 $sec^{-1}$ and higher in the case of several liquid abrasive cleaning compositions. Naturally, the shear rate at which such a break-down may occur is dependent upon the qualitative and quantitative composition of the liquid medium or suspension, and can easily be determined by the reduction in viscosity and change in appearance of the liquid medium or suspension when subjected to high extensional shear rates.

The liquid media normally comprise aqueous media in which an anionic detergent material is present, together with a suitable electrolyte dissolved in the aqueous media to convey to the aqueous media suspending properties. Preferably such aqueous media also contain a nonionic detergent material. For liquid abrasive cleaning compositions such systems have, inter alia, been described in U.K. Patent Specifications Nos. 882 569 and 955 081. Typically for such liquid abrasive cleaning compositions the aqueous suspending medium comprises an anionic detergent, a fatty acid dialkylolamide as the nonionic detergent, and a condensed phosphate as the dissolved electrolyte.

It has now been found that if the dissolved condensed phosphate in the above formulations is partly or completely replaced by another, non condensed phosphate electrolyte and if a fatty acid monoalkylolamide is used instead of a fatty acid dialkylolamide, the final product is substantially more stable against high extensional shear rates than the corresponding product comprising fatty acid dialkylolamide instead of the fatty acid monoalkylolamide and containing only the condensed phosphate as the dissolved electrolyte.

Consequently, in its broadest aspects the present invention provides a liquid detergent composition with improved stability against high extensional shear rates, comprising an aqueous suspending medium which contains an anionic detergent material, an electrolyte dissolved in said aqueous medium and a fatty acid alkylolamide, characterized in that the fatty acid alkylolamide is or predominantly comprises a fatty acid monoalkylolamide, and the electrolyte is or comprises a non condensed phosphate electrolyte.

Fatty acid alkylolamides, both the di- and the monoalkylolamides, are materials well-known per se. They can be prepared in various ways, such as by condensation of fatty acids or esters thereof with an alkanolamine, or the reaction of an alkylene oxide with a fatty acid amide. Depending upon the alkanolamine or alkylene oxide used and the amount thereof, the reaction temperature, optionally a catalyst, a reaction product is obtained containing predominantly a di- or monoalkylolamide, together with by-products such as mono- and diester-amides, alkylolamine soaps, amine mono- and diesters, free alkanolamines, etc. A full discussion of these compounds, and their preparation is given in "Nonionic Surfactants", M. Schick, 1967, chapter 8 and chapter 12. The fatty monoalkylolamides used in the present invention can be represented by the following formula:

R-CO-NH-R'-OH in which R is a branched or straight chain $C_8$–$C_{24}$ alkyl radical, preferably a $C_{10}$–$C_{16}$ alkyl radical and R' is a $C_1$–$C_4$ alkyl radical, preferably an ethyl radical.

In the technical manufacture of fatty acid monoalkylolamides one tries to achieve as high a yield of monoalkylolamides as possible, but still frequently the technical product contains certain amounts of by-products, including fatty acid dialkylolamides. These technical products, having a predominant amount of fatty acid mono-alkylolamide, are also contemplated within the scope of the present invention.

A typical, and preferred example of a fatty acid monoalkylolamide in the present invention is coco fatty acid monoethanolamide, in which the coco fatty acid refers to the fatty acids predominantly present in coconut or palm-kernel oil. These fatty acids are predominantly $C_{12}$ and $C_{14}$ fatty acids.

The amount of fatty acid monoalkylolamide used in the present invention is from 0.3–5, preferably from 0.5–3% by weight of the final product. These amounts refer to the fatty acid monoalkylolamide and do not take into account the presence of by-products in technical fatty acid alkylolamides.

The aqueous medium furthermore comprises an anionic detergent. Typical examples of anionic detergents are alkali metal or alkanolamine salts of $C_{12}$–$C_{18}$ branched or straight chain alkylaryl sulphonates, of $C_{12}$–$C_{18}$ paraffin sulphonates, of $C_8$–$C_{18}$ branched or straight chain alkyl sulphates, of $C_{10}$–$C_{18}$ alkyl $(EO)_{1-10}$ sulphates, of $C_{10}$–$C_{24}$ fatty acid soaps, etc.

Other anionic detergents, as well as mixtures of different anionic detergents, are also suitable. The amounts to be used may vary widely, dependent upon the type and purpose of the liquid composition. In general the amount will vary between 0.5 and 15, preferably between 2 and 10% by weight of the final composition.

The electrolyte, dissolved in the aqueous medium, is or comprises a non condensed phosphate electrolyte. These can be simple salts such as alkali metal chlorides, alkali metal nitrates, alkali metal silicates, alkali metal borates, alkali metal carbonates, alkali metal sulphates, alkali metal orthophosphates, alkali metal citrates, alkali metal nitrilotriacetates and mixtures thereof. The alkali metal is preferably sodium or potassium, especially sodium. Preferably a sodium or potassium carbonate, -bicarbonate or -sesquicarbonate or mixtures thereof are used as the non condensed phosphate electrolyte. The amount of the dissolved electrolyte is up to 20%, preferably up to 10% by weight of the final composition, the minimum amount being 0.5% by weight of the final composition. An especially preferred range is from 1-6% by weight of the final composition.

The non condensed phosphate electrolyte can be the sole dissolved electrolyte, or it can be used in admixture with condensed phosphates such as the alkali metal pyro- and polyphosphates, the total amount of dissolved electrolytes being within the ranges indicated above. A preferred combination of dissolved electrolytes is a combination of sodium carbonate and pentasodium tripolyphosphate, especially in a weight ratio of 1:1.

It is often desirable to include also a nonionic detergent in the aqueous medium in an amount of 0.3-5, preferably 0.5-3% by weight. All the above percentages are by weight of the final composition.

Suitable examples of nonionic detergents are water-soluble condensation products of ethylene- and/or propylene oxide with linear primary or secondary $C_8$-$C_{18}$ alcohols, $C_8$-$C_{18}$ fatty acid amides or fatty acid alkylolamides (both mono- and diamides), $C_9$-$C_{18}$ alkylphenols, and so on. The alkoxylated $C_8$-$C_{18}$ fatty acid mono- and dialkylolamides should contain more than one alkylene oxide unit; for instance they should be condensed with e.g. 2-5 moles of alkylene oxide such as ethylene oxide. Trialkylamineoxides having one long alkyl chain ($C_8$-$C_{18}$) and two short ($C_1$-$C_4$) alkyl chains are also suitable nonionic detergents.

The undissolved particulate materials which can be suspended in the liquid composition of the invention are those which are partly or completely insoluble in the liquid suspending media, such as particulate abrasive materials, pigments, insoluble builders such as zeolites, and high levels (i.e. above their water-solubility) of inorganic or organic builder salts. Preferably the material is a particulate abrasive material, such as calcite. The insoluble particulate material should be non-colloidal. The abrasive material is generally present in an amount of 1-65, preferably 2-60% by weight of the final composition. The present invention is particularly applicable to liquid abrasive cleaning compositions.

The compositions may furthermore comprise other ingredients useful in liquid detergent compositions, such as perfumes, colouring agents, fluorescers, hydrotropes, soil-suspending agents, bleaching agents, enzymes, opacifiers, germicides, humectants, etc. Thus, for example, where the invention is applied to liquid abrasive cleaning compositions, these may usefully futher comprise the usual perfumes, ammonia and the like.

The products of the invention can be prepared in any suitable way, for example by adding an aqueous dispersion of the fatty acid monoalkylolamide to an aqueous solution of the anionic detergent, or by adding a melt of the fatty acid monoalkylolamide to the aqueous solution of anionic detergent.

The invention will further illustrated by way of example.

EXAMPLE 1

Liquid abrasive cleaning compositions were prepared, having the following formulations:

| | Comparison | A | B |
|---|---|---|---|
| Sodium dodecylbenzene sulphonate | 3.2 | 3.2 | 3.2 |
| $C_9$-$C_{11}$ primary alcohol, condensed with 6 moles of ethylene oxide | 0.9 | 0.9 | 0.9 |
| Coconut fatty acid monoethanolamide (melting point 65°-71° C.) | 0.9 | 0.9 | 0.9 |
| Sodium tripolyphosphate | 2.5 | 1.25 | — |
| Sodium carbonate | — | 1.25 | 2.5 |
| Calcite | 54 | 54 | 54 |
| Perfume | 0.3 | 0.3 | 0.3 |
| Ammonia | 0.04 | 0.04 | 0.04 |
| Preservative | 0.01 | 0.01 | 0.01 |
| Water | balance | | |

These products were prepared by making an aqueous premix of the preservative as well as making an aqueous premix of the nonionic detergent and the coconut fatty acid monoalkylolamide at a temperature above the melting point of the latter compound, and mixing these two premixes with a main mix containing the remaining ingredients.

These products were also compared with a current commercial liquid abrasive cleaning composition as control, which contains anionic detergent active materials and a coconut fatty acid diethanolamide, and sodium tripolyphosphate as electrolyte at a level of 4.7%. The above products were assessed as to the effect of extensional flow on their stability. The results of these assessments are shown in the Table below. The physical stability was also assessed under normal conditions after storage for 3 months at 0° C.

TABLE A

| Extensional | Viscosity cP; 25° C. at 21 $sec^{-1}$) of product | | | | Stability (3 months 0° C.) of product | | | |
|---|---|---|---|---|---|---|---|---|
| Shear Rate ($Sec^{-1}$) | Control | Comparison | A | B | Control | Comparison | A | B |
| Unsheared | 892 | 927 | 995 | 927 | OK | OK | OK | OK |
| 37,700 1 pass | 480 | 875 | 961 | 961 | 28% AL 6% SC | 18% AL 5% SC | OK | OK |
| 37,700 2 passes | 343 | 652 | 944 | 978 | 42% AL 22% SC | 45% AL 48% SC | OK | OK |
| 37,700 | 274 | 412 | 1030 | 995 | 50% AL | 48% AL | OK | 1% |

TABLE A-continued

| Extensional Shear Rate ($Sec^{-1}$) | Viscosity cP; 25° C. at 21 $sec^{-1}$) of product | | | | Stability (3 months 0° C.) of product | | | |
|---|---|---|---|---|---|---|---|---|
| | Control | Comparison | A | B | Control | Comparison | A | B |
| 4 passes | | | | | 34% SC | 50% SC | | AL |

AL = Aqueous Layer
SC = Sedimented Calcite

As can be seen from these data, the products A and B according to the invention were stable against high extensional shear rates, whereas the control was not. The comparison product, containing only sodium tripolyphosphate as the dissolved electrolyte, was equally not stable against the high extensional shear rates.

EXAMPLE 2

The following products were prepared and compared in the manner as described in Example 1, using the same control composition.

| | Comparison | C | D |
|---|---|---|---|
| Sodium dodecylbenzene sulphonate | 3.5 | 3.5 | 3.5 |
| $C_9$–$C_{11}$ primary alcohol, condensed with 6 moles ethylene oxide | 1.0 | 1.0 | 1.0 |
| Coconut fatty acid monoethanolamide | 0.5 | 0.5 | 0.5 |
| Sodium tripolyphosphate | 2.0 | 1.0 | — |
| Sodium carbonate | — | 1.0 | 2.0 |
| Calcite | 54 | 54 | 54 |
| Perfume | 0.3 | 0.3 | 0.3 |
| Ammonia | 0.04 | 0.04 | 0.04 |
| Preservative | 0.01 | 0.01 | 0.01 |
| Water | | balance | |

The following results were obtained:

TABLE B

| Extensional Shear Rate ($Sec^{-1}$) | Viscosity (cP at 20 $sec^{-1}$ and 25° C.) of product | | | | Stability - 1 day at Room Temperature | | | |
|---|---|---|---|---|---|---|---|---|
| | Control | Comparison | C | D | Control | Comparison | C | D |
| Unsheared | 981 | 800 | 955 | 916 | OK | OK | OK | OK |
| 40,000 1 pass | 568 | 955 | 877 | 955 | 7% WL 2% SC | OK | OK | OK |
| 40,000 2 passes | 413 | 1019 | 877 | 903 | 12% WL 2% SC | OK | OK | OK |
| 40,000 4 passes | 284 | 1045 | 903 | 929 | 20% WL 8% SC | OK | OK | OK |

WL = Watery Layer
SC = Sedimented Calcite

The comparison product, containing only sodium tripolyphosphate as the dissolved electrolyte, showed an increase in viscosity when subjected to high extension shear. On storing this product for longer periods, a marked increase in viscosity is observed, which is undesirable. The products C and D of the invention are stable when subjected to high extensional shear, yet do not suffer from an increase in viscosity when stored over longer periods.

We claim:

1. An aqueous liquid abrasive cleaning composition comprising 1–65% of a non-colloidal undissolved particulate abrasive material stably suspended in an aqueous liquid medium, said medium comprising from 0.5 to 15% by weight of an anionic detergent active material, from 1 to 6% by weight of an electrolyte salt mixture of sodium carbonate and sodium tripolyphosphate dissolved in said aqueous liquid medium, and from 0.3 to 5% by weight of $C_8$–$C_{24}$ fatty acid monoalkylolamide wherein the alkylol group contains from 1 to 4 carbon atoms.

2. A composition according to claim 1, wherein the dissolved electrolyte salt comprises from 1 to 6% by weight of a 1:1 w/w mixture of sodium carbonate and sodium tripolyphosphate.

3. A composition according to claim 1, further comprising from 0.3 to 5% by weight of a nonionic detergent selected from the group consisting of alkylene oxide condensation products with linear primary $C_8$–$C_{18}$ alcohols, with linear secondary $C_8$–$C_{18}$ alcohols, with $C_8$–$C_{18}$ fatty acid amides, with $C_8$–$C_{18}$ fatty acid alkylolamides containing more than one alkylene oxide unit, and with $C_9$–$C_{18}$ alkylphenols.

* * * * *